United States Patent [19]

Wagdy

[11] Patent Number: 4,597,517

[45] Date of Patent: Jul. 1, 1986

[54] MAGAZINE INTERLOCK FOR A FASTENER DRIVING DEVICE

[75] Inventor: Mohamed K. Wagdy, Des Plaines, Ill.

[73] Assignee: Signode Corporation, Glenview, Ill.

[21] Appl. No.: 747,451

[22] Filed: Jun. 21, 1985

[51] Int. Cl.[4] ..... B25C 1/04; B25C 5/06; B25C 7/00

[52] U.S. Cl. ..... 227/8; 227/125; 227/120

[58] Field of Search ..... 227/8, 120, 125, 126, 227/130, 131

[56] References Cited

U.S. PATENT DOCUMENTS

| | | | |
|---|---|---|---|
| 2,979,725 | 4/1961 | Wandel et al. | 227/130 X |
| 3,141,171 | 7/1964 | Doyle et al. | 227/8 |
| 3,194,324 | 7/1965 | Langas | 227/8 |
| 3,198,412 | 8/1965 | Roosa | 227/120 X |
| 3,519,186 | 7/1970 | Volkmann | 227/8 |
| 3,568,908 | 3/1971 | Bader | 227/136 X |
| 3,615,049 | 10/1971 | Obergfell et al. | 227/8 |
| 3,858,781 | 1/1975 | Obergfel et al. | 227/8 |
| 4,197,974 | 4/1980 | Morton et al. | 227/8 |
| 4,463,888 | 8/1984 | Geist et al. | 227/126 X |
| 4,483,474 | 11/1984 | Nikolich | 227/8 |
| 4,549,681 | 10/1985 | Yamamoto et al. | 227/8 |

FOREIGN PATENT DOCUMENTS

| | | | |
|---|---|---|---|
| 2443544 | 3/1976 | Fed. Rep. of Germany | 227/8 |

*Primary Examiner*—Robert L. Spruill
*Assistant Examiner*—Taylor J. Ross
*Attorney, Agent, or Firm*—Dressler, Goldsmith, Shore, Sutker & Milnamow, Ltd.

[57] ABSTRACT

A pneumatic fastener driving tool of the hand held gun type having means for positively insuring against accidental firing when the fastener magazine is empty or detached, or when the nosepiece is not pressed against a workpiece. The means comprises a linkage train including an intermediate link carried by the magazine and movable by a first link reciprocably associated with the nosepiece to move a second link associated with the trigger assembly to render the trigger operational for firing the tool. There are locking means associated with the feeder of the fasteners for locking the intermediate link in an inoperative position when the magazine is empty of fasteners.

12 Claims, 4 Drawing Figures

MAGAZINE INTERLOCK FOR A FASTENER DRIVING DEVICE

TECHNICAL FIELD

This invention relates to portable fastener driving tools of the type which are hand held and pneumatically actuated and, more particularly, to a fastener driving device of that type having a mechanism for positively insuring against inadvertent firing of the device.

BACKGROUND OF THE INVENTION

Hand held, pneumatically operated fastener driving tools are old and well known and enjoy widespread use in many areas, such as, the construction field. In general, such tools comprise a gun-like body having a piston-cylinder driver means connected to a pneumatic source, a drive track into which are fed individual fasteners from an attached magazine, and a nosepiece for contacting the workpiece so that a fastener can be driven thereinto. The tools invariably assume the shape of a form of handgun having a handle and an associated trigger for actuating the driver. Those skilled in the art will appreciate that the fasteners are driven from such tools with relatively high and explosive forces which renders dangerous improper or accidental use of the tools. Accordingly, there have been numerous prior efforts at providing mechanisms for preventing such inadvertent or accidental uses from occurring.

A common and well known expedient is the use of a movable nosepiece which normally de-activates the tool and prevents firing until the nosepiece is pressed against a workpiece. Representative examples of such nosepiece arrangements may be seen in U.S. Pat. Nos. 3,194,324; 3,198,412; and 3,519,186. In each of those prior art devices, the movable nosepiece comprises an element of the main housing and is linked directly to the trigger means for preventing unintentional firing. Pat. No. 3,198,412 also teaches a means for inactivating the trigger means when the magazine is empty or almost empty of staples. Another example of the movable nosepiece feature is shown in U.S. Pat. No. 2,979,725, where the nosepiece and actuating member are carried by the fastener magazine which is removable from the main housing. In the latter device, the movable actuating member controls the pneumatic valve arrangement rather than acting upon the trigger means itself.

Yet there exists a need for a mechanism that positively insures against firing when the fastener magazine is empty or has been detached from the housing. This need exists because of the not unlikely possibility that a single fastener may remain unobserved in the drive track even when the magazine has been removed or is seen to be empty of fasteners. Moreover, it is desirable that such additional mechanism act to de-activate the trigger mechanism rather than the pneumatics because of the natural tendency to carry a gun-like device by its handle so that one or more fingers automatically rest on the trigger means.

SUMMARY OF THE INVENTION

The present invention provides a portable fastener driving tool having means for insuring positively that inadvertent firing cannot occur when the magazine is detached or empty.

The invention comprises an intermediate link between the movable nosepiece and the trigger means which forms an integral part of a complete linkage train between nosepiece and trigger. If the intermediate link is removed or prevented from moving, the trigger is de-activated even if the nosepiece is pressed against a workpiece.

In a preferred embodiment, the intermediate link is carried by the detachable fastener magazine so that detachment of the magazine renders firing impossible. The magazine also carries a locking means which automatically prevents movement of the intermediate link when the last fastener has been fired from the drive track.

To complete the linkage train, there is a third spring-urged member carried by the main housing which is movable by the intermediate link to activate the trigger.

Other features and advantages of the invention will be apparent from the following description and claims and are illustrated in the accompanying drawings which show structure embodying the preferred features of the present invention and the principles thereof.

BRIEF DESCRIPTION OF THE DRAWINGS

In the accompanying drawings forming part of the specification, and in which like numerals are employed to designate like parts of the same.

DETAILED DESCRIPTION OF THE INVENTION

Figure 1:
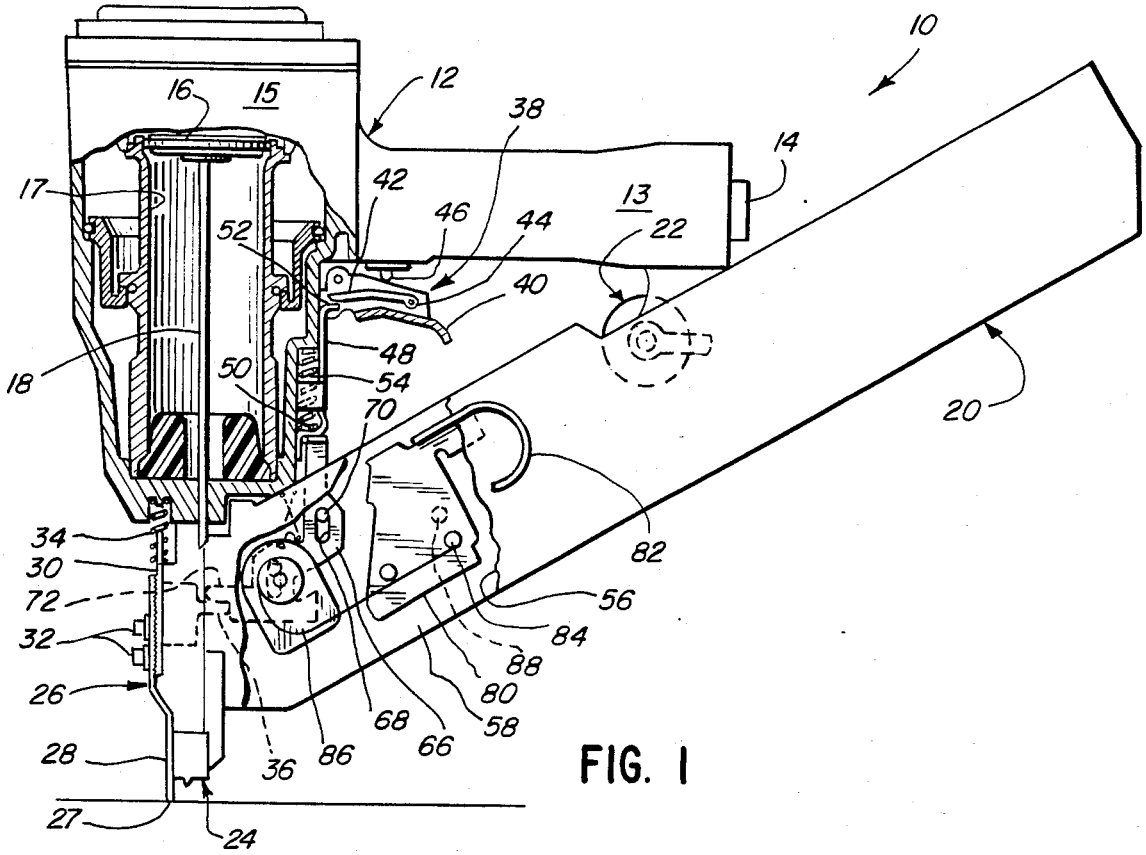
FIG. 1 is a side elevation view of a portable fastener driving device embodying the principles of the invention with the magazine attached and in the ready, but non-firing condition.

The particular tool disclosed and illustrated in the drawings is a pneumatic nailer, but as such is merely exemplary of the family of tools into which the invention may be incorporated. In general, the basic housing, handle, nail magazine and pneumatics structure may be similar to that shown in the above mentioned U.S. Pat. No. 3,194,324; and only so much of the inventive likage and safety mechanism as is necessary for an understanding and practice of the invention will be described in detail.

Referring now with greater particularity to the various figures of the drawings, it will be seen that the reference numeral 10 indicates generally a fastener driving device embodying the principles of the invention. The device 10 comprises a housing 12 having a handle portion 13 to which is connected a nipple 14 for attachment to a source of pneumatic pressure. The housing 12 also includes a barrel portion 15 containing the piston 16 located in a cylinder 17. Connected to the piston 16 is a driver means 18. A nail magazine 20 is pivotally and removably connected to the handle 13 by suitable fastening means 22.

A nosepiece 24 projects from the forward end of the barrel portion 15 of the housing, and said nosepiece carries a nail drive track which communicates with the piston-cylinder drive means.

A first link, or work contacting member 26 is mounted from the nosepiece 24. The work contacting member 26 may comprise a pair of members 28 and 30 connected together and mounted to the nosepiece by firing bolts 32. The member 30 is biased outwardly by a spring 34 disposed in a recess in the barrel portion 15 so that the tip 27 of the member 26 is normally positioned forwardly of the tip of the nosepiece as illustrated in FIG. 1. The members 28 and 30 may likewise include cooperating serrations whereby the amount by which the tip 27 of the member 28 projects beyond the tip of the nosepiece may be adjusted to vary the depth to which a driven nail will penetrate the workpiece. An actuator finger 36 is connected to the member 30 and projects through a slot formed in the nosepiece 24 so that the same is reciprocable therein.

Trigger means 38 is pivotally mounted from the housing 12 and comprises a finger grip 40 and a safety trigger lever 42 pivotally mounted at 44 in said finger grip. The trigger lever 42 is adapted to depress a button 46 projecting from the handle 13 for actuating the piston-cylinder driver means. The trigger lever 42 is free to pivot at 44 so that movement of the finger grip 40 in the consition illustrated in FIG. 1 will be ineffective to depress the button 46 for actuating the driver means.

An actuating link 48 having a forward shoulder 50 and a trigger camming leg 52 is slidably mounted on the housing barrel 15. The link 48 is biased by a spring means 54 acting against the shoulder 50 so that camming leg 52 is normally out of engagement with trigger lever 42 thereby rendering the trigger means ineffective as illustrated in FIG. 1.

Nail magazine 20 comprises a pair of opposed mating members 56,58 shaped to afford an inner cavity and a guideway for holding a supply of nails. The assembled magazine members 56 and 58 comprise a forward edge 60 and a connector pin 62 for flush operational connection to the nosepiece 24 and the drive track contained therein.

An intermediate link 64 is carried by the magazine 20 for completing the linkage train between the work contacting member 26 and the trigger lever 42. Link 64 comprises a plate 66 having a pair of slots 68,68 and is slidably mounted on the magazine by a pair of mounting pins 70,70 positioned through said slots. The plate 66 comprises further an actuating finger 72 projecting forwardly thereof an abutment shoulder 74 projecting above the magazine 20 and a locking notch 76 opening rearwardly thereof. The plate 66 is biased downardly by a spring means 78 so that the plate normally occupies the non-firing position illustrated in FIGS. 1, 3, and 4. When the magazine is operationally connected to the nosepiece 24, the actuating finger 72 is aligned with and adapted to be engaged by the actuator finger 36, while the abutment shoulder 74 is aligned with and adapted to engage the shoulder 50 of the actuating link 48.

Figure 2:
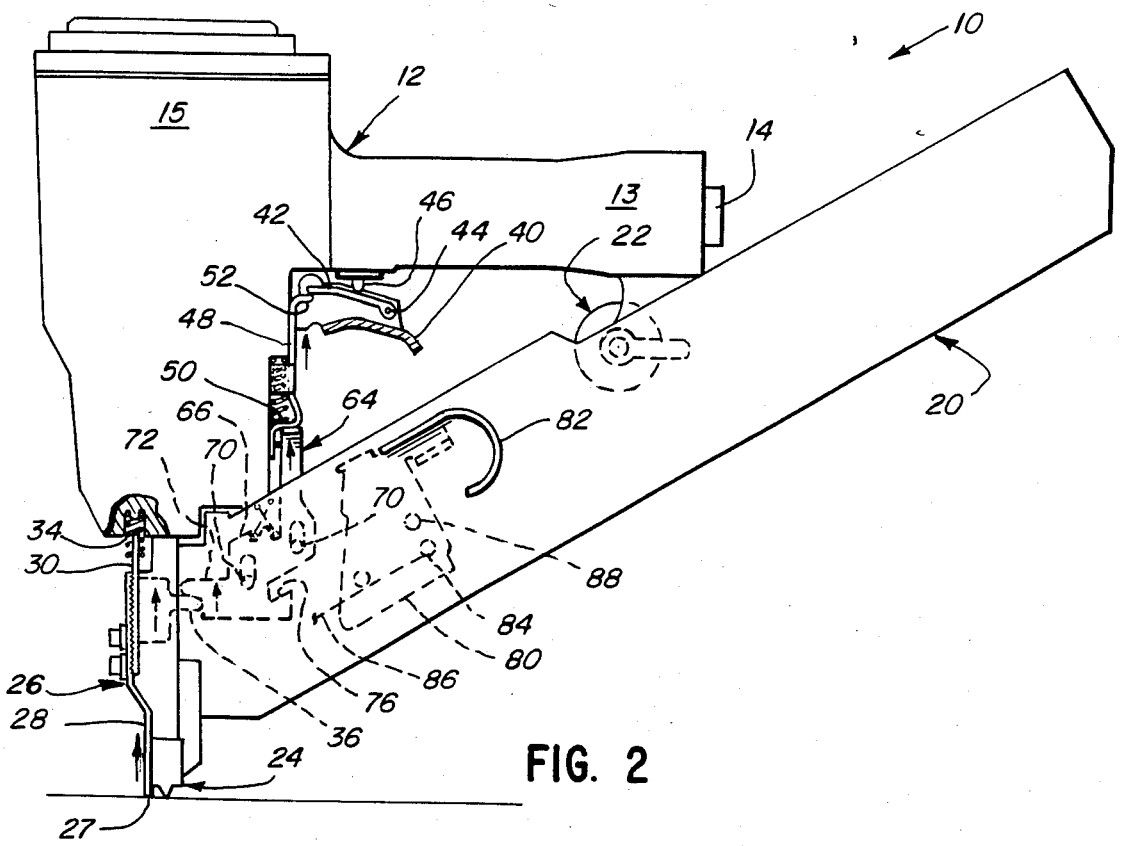
FIG. 2 is a similar view but with the nosepiece pressed against a workpiece to move the linkage train and activate the trigger for firing.

A nail feeder plate 80 is slidably retained between the magazine members 56 and 58, said plate 80 comprising an external finger-grippable hook 82 and a post 84 to which is connected the end of a coiled leaf spring means 86 carried by the magazine. When it is desired to fill the magazine 20 with nails, the hook 82 can be pulled rearwardly against the bias of the spring means 86, and thereafter the plate 80 will urge the supply of nails forwardly for discharge in a well known conventional manner. Thus, in FIGS. 1 and 2 of the drawings, the plate 80 is shown positioned as it would be with a small supply of nails still remaining in the magazine.

Figure 3:
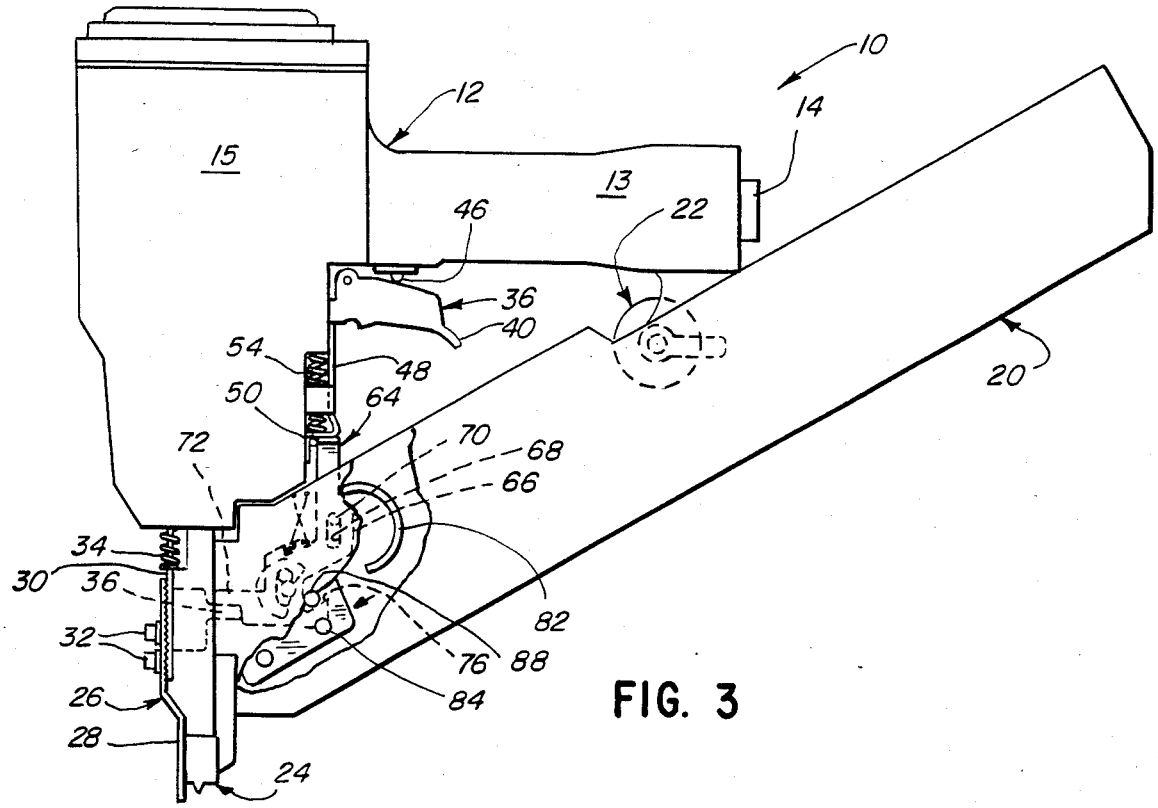
FIG. 3 is a view similar to FIG. 1 but showing the intermediate link locked against further movement because the magazine is empty of fasteners.
Figure 4:
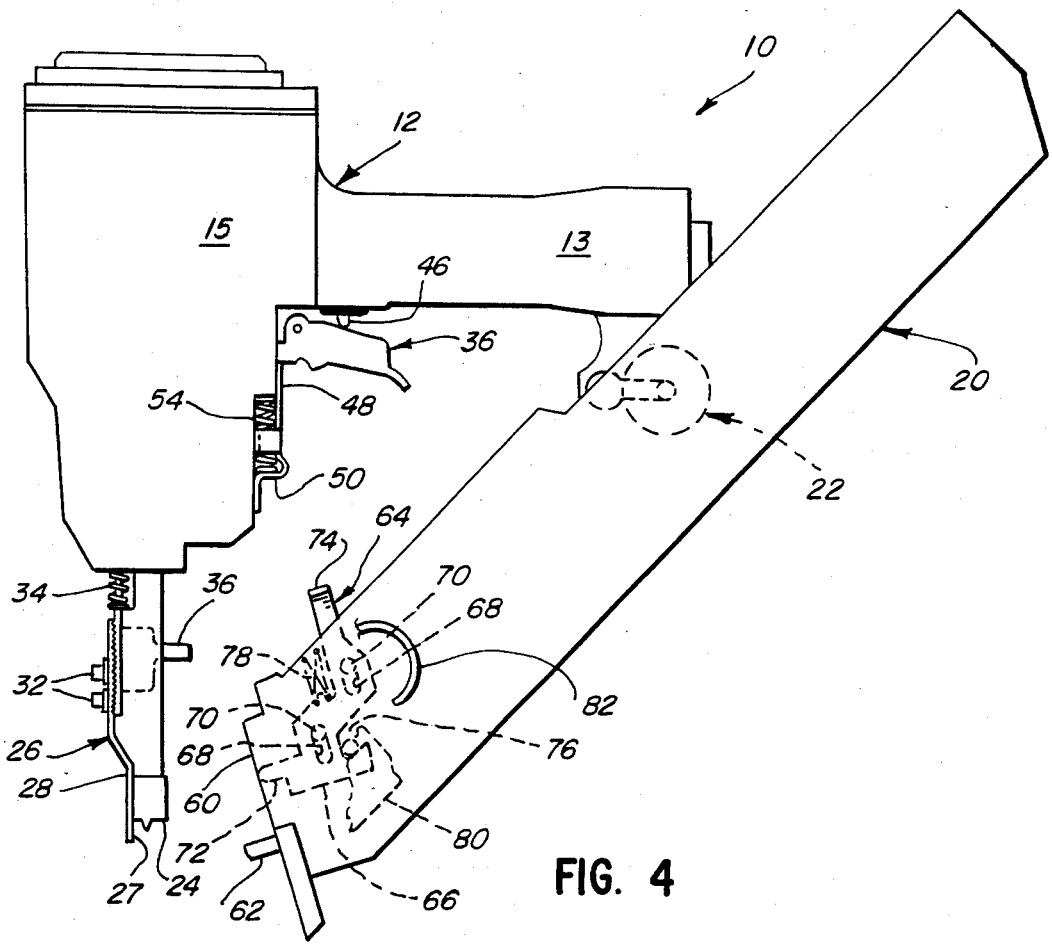
FIG. 4 is a similar view showing the empty magazine pivoted away and disconnected from the nosepiece.

The feeder plate 80 has projecting from a face thereof a locking pin 88. The locking pin 88 is positioned to enter the locking notch 76 of the link plate 66 when the magazine 20 is empty or the last nail has been fed to the nosepiece 24 and fired from the drive track. This latter condition is illustrated in FIGS. 3 and 4 of the drawings, where it will be seen that the link plate 66 has been locked in the non-firing position.

To operate the tool 10 when the magazine contains a supply of nails, the work contacting member 26 is pressed against the workpiece until the nosepiece 24 bears against the workpiece. The upward movement of the member 26 causes the actuator finger 36 to urge the actuating finger 72 and link plate 66 upwardly so that the abutment shoulder 74 forces the actuating link 48 upwardly and the camming leg 52 bears against the trigger lever 42. Finger operation of the trigger means 38 is now effective to depress the button 46 and fire the leading nail into the workpiece. Elimination of the operation of the link plate 66, either by disconnection of the magazine or locking cooperation of the pin 88 and notch 76 when the magazine is empty, renders the trigger means 38 ineffective and insures against accidental firing of the tool. If desired, the firing procedure may be reversed by first squeezing the trigger means and then pressing the member 26 against the workpiece.

While a preferred embodiment of the invention has been illustrated and described herein, it will be appreciated that changes and variations may be made by those skilled in the art without departing from the spirit and scope of the appended claims. The invention is defined by the claims that follow.

What is claimed is:

1. In a portable fastener driving device comprising a housing having a nose portion, a piston and cylinder means in said housing including a driver secured to said piston, which driver extends through a drive track defined by said nose portion, a fastener magazine connected to said housing adjacent said nose portion and positioned to dispose succeeding fasteners in said drive track, means for controlling the operation of said piston including a trigger assembly, a linkage assembly disposed adjacent said nose portion and said trigger assembly whereby said trigger assembly cannot be operated to drive a fastener into a workpiece until the nose portion of the tool is in engagement with the workpiece, said linkage assembly including a first member movably connected to said nose portion, spring means biasing said first member to extend beyond said nose portion, a second member connected to said magazine and a third member movably secured to said housing and biased away from said trigger but movable to render the trigger operational to drive a fastener.

2. A fastener driving device according to claim 1 wherein said second member is movably connected to said magazine and is biased away from said third member but is movable by said first member to move said third member and render the trigger operational.

3. A fastener driving device according to claim 2 comprising locking means on said magazine and second member cooperable to lock said second member in the normally biased position when the magazine is empty of fasteners to thereby prevent operation of the trigger.

4. A fastener driving device according to claim 3 wherein said magazine is detachable from said nose portion whereby said second member is removed from the linkage assembly to render the trigger inoperative.

5. A fastener driving device according to claim 2 wherein said trigger assembly comprises a trigger lever freely pivotable and normally ineffective to operate the piston for driving a fastener, said third member being movable to engage said trigger lever to prevent the free pivoting thereof and render the trigger operational.

6. In a portable fastener driving tool operated by air pressure and comprising a housing, piston and cylinder means in said housing including a driver for driving fasteners into a workpiece, a nosepiece on said housing defining a drive track adapted to receive fasteners to be driven, a fastener magazine detachably connected to said nosepiece, and a manually operable trigger means on the housing for actuating the driver but normally inoperative to drive a fastener into a workpiece, the improvement comprising:

a linkage train between the nosepiece and the trigger means for rendering the trigger means operational to drive a fastener, said linkage train including, first and second links movably associated with the nosepiece and trigger means respectively, and an intermediate link movably mounted on said magazine and biased out of operational engagement with said second link but movable by said first link to move said second link to render the trigger operational.

7. A fastener driving tool according to claim 6 and comprising spring means biasing said first link to extend beyond said nosepiece whereby the trigger means cannot be rendered operational until said first link is pressed against a workpiece.

8. A fastener driving tool according to claim 7 wherein said magazine is detachable from the nosepiece to move said intermediate link and interrupt the linkage train whereby the trigger means cannot be rendered operational.

9. A fastener driving tool according to claim 7 wherein said intermediate link comprises a plate having an actuating finger projecting forwardly thereof toward said nosepiece and an abutment shoulder projecting upwardly therefrom toward said second link, and being upwardly movable by said first link whereby said abutment shoulder engages said second link to render the trigger means operational.

10. A fastener driving tool according to claim 9 and comprising an actuator finger carried by said first link, said actuator finger adapted to engage the actuating finger of said intermediate link when said first link is pressed against a workpiece.

11. A fastener driving tool according to claim 10 and comprising locking means on said plate and magazine for locking said plate in the normally biased position when the magazine is empty of fasteners whereby said trigger means cannot be rendered operational.

12. A fastener driving tool according to claim 11 and comprising spring-urged follower means on said magazine for feeding the fasteners to the drive track, said locking means comrising a locking notch in the rear edge of said plate and a locking pin on said follower means for engaging said plate when the magazine is empty of fasteners.

* * * * *